US008337337B2

(12) United States Patent
Lay

(10) Patent No.: US 8,337,337 B2
(45) Date of Patent: Dec. 25, 2012

(54) HITTING DEVICE

(76) Inventor: William Coleman Lay, Saint George, UT (US)

( * ) Notice: Subject to any disclaimer, the term of this patent is extended or adjusted under 35 U.S.C. 154(b) by 0 days.

(21) Appl. No.: 12/480,698

(22) Filed: Jun. 9, 2009

(65) Prior Publication Data

US 2010/0311524 A1 Dec. 9, 2010

(51) Int. Cl.
*A63B 71/00* (2006.01)
*A63B 69/00* (2006.01)

(52) U.S. Cl. ..... 473/417; 473/451

(58) Field of Classification Search ..... 473/417, 473/420, 451, 386, 387, 390, 391; D21/717
See application file for complete search history.

(56) References Cited

U.S. PATENT DOCUMENTS

| | | | | | |
|---|---|---|---|---|---|
| 1,564,212 | A | * | 12/1925 | Decker | 473/390 |
| 1,611,332 | A | * | 12/1926 | Bunnell | 473/389 |
| 1,738,596 | A | * | 12/1929 | McLeod | 473/391 |
| 1,759,657 | A | * | 5/1930 | McLeod | 473/399 |
| 1,815,520 | A | * | 7/1931 | McLeod | 473/399 |
| 3,099,452 | A | * | 7/1963 | Fernicola | 473/280 |
| 3,690,676 | A | * | 9/1972 | Costa | 473/398 |
| 3,874,662 | A | * | 4/1975 | Harrington | 473/417 |
| 4,136,869 | A | * | 1/1979 | Tassone | 473/417 |
| 4,176,838 | A | | 12/1979 | Griffin | |
| 4,681,318 | A | | 7/1987 | Lay | |
| 4,796,885 | A | * | 1/1989 | Wright | 473/417 |
| 4,830,371 | A | | 5/1989 | Lay | |
| 4,854,587 | A | | 8/1989 | Groves | |
| 4,886,267 | A | * | 12/1989 | Licciardi et al. | 473/417 |
| 4,938,478 | A | | 7/1990 | Lay | |
| 5,002,274 | A | * | 3/1991 | Bidema | 473/417 |
| 5,100,134 | A | * | 3/1992 | Becker | 473/417 |
| 5,242,161 | A | * | 9/1993 | Wilkirson | 473/386 |
| 5,282,615 | A | * | 2/1994 | Green et al. | 473/418 |
| 5,320,343 | A | | 6/1994 | McKinney | |
| 5,556,091 | A | * | 9/1996 | Lin | 473/417 |
| 5,613,678 | A | * | 3/1997 | McKee et al. | 473/417 |
| 5,772,536 | A | * | 6/1998 | Wang | 473/417 |
| 5,916,045 | A | * | 6/1999 | Busch | 473/417 |
| 5,928,092 | A | * | 7/1999 | Keeter et al. | 473/417 |
| 6,045,462 | A | * | 4/2000 | Mourek | 473/417 |
| 6,146,289 | A | | 11/2000 | Miller | |
| 6,398,671 | B1 | | 6/2002 | Rios | |
| 6,652,394 | B1 | * | 11/2003 | Tener | 473/417 |
| 6,988,963 | B2 | * | 1/2006 | Lubosco et al. | 473/387 |
| 7,037,218 | B2 | * | 5/2006 | Lubosco et al. | 473/387 |
| 7,115,052 | B2 | * | 10/2006 | Wardle et al. | 473/459 |
| 7,204,769 | B2 | | 4/2007 | Bandimere | |
| 7,510,491 | B2 | * | 3/2009 | Lortscher | 473/417 |
| 7,749,142 | B2 | * | 7/2010 | Kuhagen | 482/129 |
| 2003/0032506 | A1 | * | 2/2003 | Chi | 473/417 |
| 2004/0185968 | A1 | * | 9/2004 | Livingstone | 473/417 |
| 2007/0049426 | A1 | * | 3/2007 | Huang | 473/417 |

* cited by examiner

*Primary Examiner* — Mitra Aryanpour

(57) ABSTRACT

The present invention provides for the first time a hitting device having a plural ended pedestal. The plural ended pedestal includes at least one end having a pedestal for supporting objects and at least one end having a smaller pedestal for supporting smaller objects.

23 Claims, 8 Drawing Sheets

HITTING DEVICE

BACKGROUND

1. Field of Invention

The present invention relates to sports products and more particularly to a hitting device used by sports players for hitting balls and other objects.

2. Description of Prior Art

In many sports, one of the most difficult skills to master is hitting. First, a hitter must be able to coordinate the swing of a bat, club, racquet, or stick while making contact with an object such as a ball, puck, or other sports projectile. Once this skill is mastered, the hitter must next learn to make good contact with the ball at various locations. In some cases the hitter must also learn to hit the object as it travels at velocities over 100 mph.

To develop good hitting skills, a player, trainer, or coach may use a variety of hitting devices. In the sports of baseball and softball, a batting tee is sometimes used.

Typical batting tees support a ball at a selected height above a representation of a home plate. The player hits the ball and the ball is then retrieved and placed on the tee for another swing. In this manner, the player can practice swinging and improve the coordination of his hands and eyes and develop his wrist and arm muscles.

Sometimes to develop a precisely focused hitter's eye, a baseball or softball hitter will train by hitting balls the size of a golf ball. These mini-balls can be made of light weight materials such as hollow plastic or foam. This makes practicing with smaller balls safe and convenient.

Traditional batting tees are typically designed to support balls the size of a baseball or softball. These batting tees are not designed to support balls the size of a golf ball.

For example, if a ball, the size of a golf ball is placed on a traditional batting tee pedestal, the golf ball sized ball will sit too far down in the pedestal and the hitter will not be able to hit the ball without hitting the stem. This will cause the hitter's bat to hit the pedestal instead of the ball and this will shock the hitter's bat and ruin the hitter's swing. This in turn will hinder the development of good hitting skills.

Because of these problems, some batting tees have been developed with smaller ball pedestals. The problem with these smaller ball batting tees is the smaller pedestal is not large enough to support larger balls. So, when a larger ball is placed on the smaller ball batting tee, the ball falls off the small pedestal especially if the wind is blowing.

Another problem, with both types of batting tees, is the ball remains in a static state. So, the user is unable to learn to hit a moving pitch. This is because the ball sits statically on top of the batting tee ball pedestal.

Another problem, with traditional batting tees, is a traditional batting tee tips over when hit by a bat. This is because the base is light-weight and is not heavy enough to withstand the force of the bat as it hits the ball and pedestal. This is extremely frustrating since the user has to bend over and pick-up the batting tee after the ball is hit.

Another problem, with traditional batting tees, is if the batting tee base is weighted, it will not tip or flex so the ball pedestal of the batting tee will take the impact of the swinging bat. This will cause the ball pedestal to break.

Another problem, with traditional batting tees, is if the batting tee doesn't flex away from the hitter's bat, the hitter will feel the shock of hitting the batting tee. This in turn will ruin the hitter's swing.

BRIEF SUMMARY OF INVENTION

In accordance with one embodiment, there is provided for the first time a hitting device having a plural ended pedestal.

The plural ended pedestal includes at least one end having a pedestal for supporting objects and at least one end that having a smaller pedestal for supporting smaller objects.

Other features of the present invention will become apparent upon reading the following detailed description of embodiments of the invention, when taken in conjunction with the appended claims.

BRIEF DESCRIPTION OF DRAWINGS

To further clarify the above and other advantages, and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

REFERENCE NUMERALS OF DRAWINGS

Figure 1A:
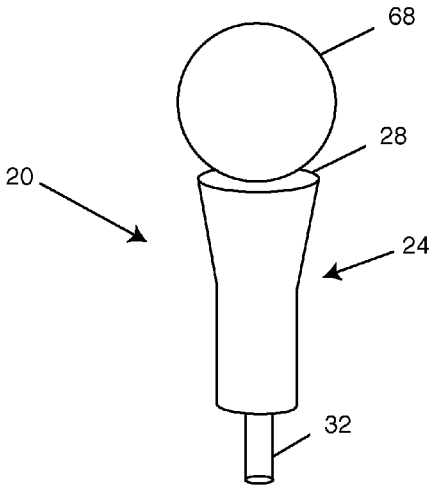
FIG. 1A is a perspective side view of a hitting device embodiment comprising a plural ended pedestal supporting an object.

20 Hitting Device
24 Plural Ended Pedestal

28 Pedestal
32 Smaller Pedestal
34 Single Size Pedestal
36 Stem
38 Telescopic
40 Upper Stem
42 Lower Stem
48 Base
50 Weight-Fillable
52 Flex Member
56 Object Holder
68 Object
72 Smaller Object
76 Location Member
77 Proximal End
78 Distal End

PREFERRED EMBODIMENTS

Description

A hitting device 20 is shown in several preferred embodiments as illustrated in FIGS. 1A-16.

A plural ended pedestal 24 is illustrated in FIGS. 1A-14B.

The plural ended pedestal 24, in one embodiment, is fabricated by creating at least one pedestal 28 and at least one smaller pedestal 32. The plural ended pedestal 24 measures approximately 9" in length. The diameter of the pedestal 28 measures approximately 1.875" while the diameter of the smaller pedestal 32 measures approximately 0.875". The length of the pedestal 24 measures approximately 7" while the smaller pedestal 32 measures approximately 2" in length. The pedestal 24 and the smaller pedestal 32 join together to form one complete plural ended pedestal 24. The plural ended pedestal 24 can vary in length from approximately 0.5" to 48". The plural ended pedestal 24 can be formed out of rubber, plastic, metal, or any suitable material for supporting objects.

Figure 15:
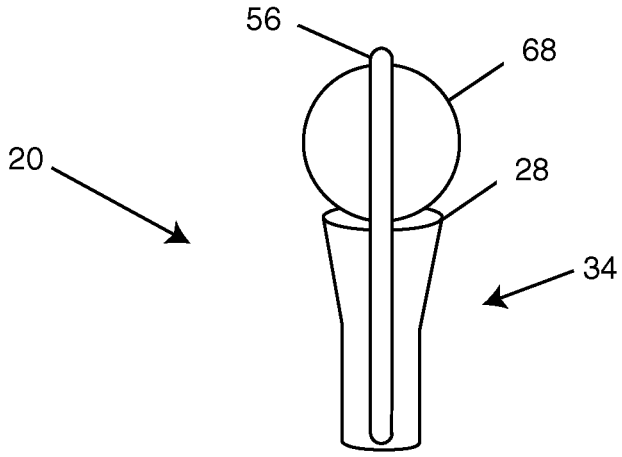
FIG. 15 is a perspective side view of a hitting device embodiment comprising a single size pedestal for supporting objects and associated object holder.
Figure 16:
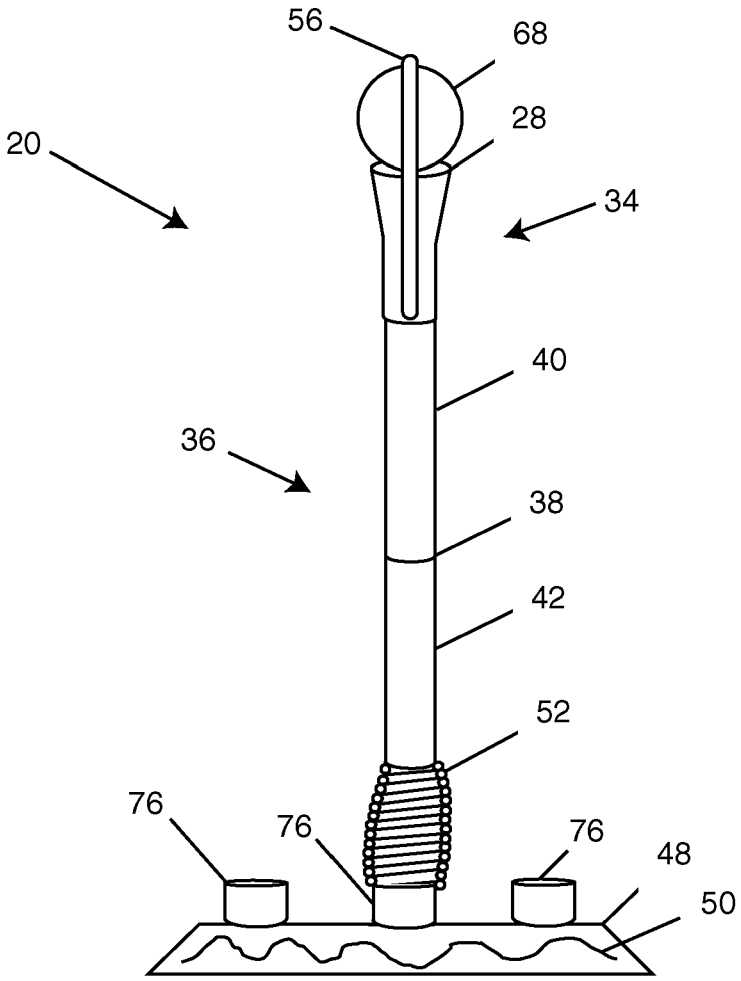
FIG. 16 is a perspective side view of a hitting device embodiment comprising an object holder.

A single size pedestal 34 is illustrated in FIGS. 15-16.

The single size pedestal 34, in one embodiment, is fabricated in the same manner as the plural ended pedestal 24, described above, excluding the smaller pedestal 32.

A stem 36 is illustrated in FIGS. 3A-14B and FIG. 16.

The stem 36, in one embodiment, measures approximately 24" in length and about 1" to 2" in diameter. The stem 36 can be made of a solid material, semi-solid material, tubular material or any material sufficient for supporting the plural ended pedestal 24 or the single size pedestal 34. Popular materials include rubber, plastic, aluminum, steel, or the like.

A telescopic 38 stem 36 is illustrated in FIGS. 4A-4B, FIGS. 11A-14B and FIG. 16.

The telescopic 38 stem 36, in one embodiment, is fabricated by making an upper stem 40 and lower stem 42. The upper stem 40 can be adjustably connected to the lower stem 42. An adjustable fastener is used to adjustably connect the upper stem 40 with the lower stem 42.

The telescopic 38 stem 36, in another embodiment, is fabricated by making the upper stem 40 smaller in diameter than the lower stem 42. In this configuration, the upper stem 40 slides inside the lower stem 42. To fabricate this embodiment, the upper stem 40 measures approximately 16" in length and has an approximate 1.125" outside diameter. The upper stem 40 can be solid, tubular, or whatever suitable construction for allowing the upper stem 40 to slide inside the lower stem 42. In this same embodiment, the lower stem 42 is tubular, hollow, or the like with an approximate length of 14". The lower stem 42 has an inside diameter of about 1.175" and the outside diameter measures approximately 1.25". To adjustably connect the upper stem 40 to the lower stem 42, a temporary fastener such as a pushpin, tightening collar, tape, or any suitable temporary locking means is used.

The telescopic 38 stem 36, in yet another embodiment, is fabricated by reversing the above design and making the upper stem 40 slide over the lower stem 42. In this design, the upper stem 40 is tubular or the like while the lower stem 42 is solid, tubular, or any suitable combination.

The telescopic 38 stem 36, in still another embodiment, is fabricated by making both the upper stem 40 and the lower stem 42 solid, tubular, or any suitable combination. In this design the upper stem 40 slides outside and along the lower stem 42.

A base 48 is illustrated in FIGS. 5A-7B, 9A-14B, and FIG. 16.

The base 48, in one embodiment, is fabricated by making a baseball or softball home plate. This home plate measures approximately 17" Wide By 17" Long By 0.5"-1.5" in height and can be made out of plastic, rubber, wood, or any suitable material strong enough to support the stem 36 and plural ended pedestal 24 or stem 36 and single size pedestal 34 in an approximate upright position. A connection means is also fabricated for connecting the home plate to the stem 36 or other elements disposed above or below the base 48.

The base 48, in another embodiment, is fabricated by making a stake that is driven into the ground or the like. This stake is disposed below the stem 36 and could be made from metal, plastic or any other suitable material. A connection means is also fabricated for attaching the stake to the stem 36, or other elements disposed above or below the base 48.

The base 48, in yet another embodiment, is fabricated from plywood, steel, concrete, or any other material suitable for supporting the stem 36 in an upright position.

A weight-fillable 50 base 48 is illustrated in FIGS. 6A-6B, FIGS. 10A-10B, FIGS. 12A-12B, and FIG. 16.

The weight-fillable 50 base 48, in one embodiment, is fabricated container that holds weighted materials such as water, sand, concrete, or the like. One way to fabricate this container is to create a blow mold and blow mold the container. This blow molded container has a solid perimeter, but is hollow inside, for allowing various amounts of weight to be added for stabilizing the base 48.

A flex member 52 is illustrated in FIGS. 8A-14B and FIG. 16.

A flex member 52, in one embodiment, is fabricated by forming a coil spring made with 0.375" diameter spring steel wire. The finished coil spring measures approximately 4" in length and has an approximate outside diameter of 1.30". The flex member 52 can also be fabricated from rubber, silicone, or any suitable resilient flexing material.

An object holder 56 is illustrated in FIGS. 2A-2B and FIGS. 13A-16.

The object holder 56, in one embodiment, is fabricated from a stretchable material such as rubber or a rubber band. The rubber or rubber band can be stretched around objects for allowing objects to be secured to the object holder 56. The rubber or rubber band releases the object when the object is impacted. Since rubber and rubber bands are stretchable, the inside diameter of the rubber or rubber band can be any size that can be stretched over different sized objects without breaking.

The object holder 56, in another embodiment, is fabricated by making a strap out of non-stretching material. This strap includes a tightening mechanism for tightly cinching the strap around objects.

An object 68 is illustrated in FIG. 1A, FIG. 2A, FIG. 13A, FIG. 14A, FIGS. 15-16.

The object 68 is a softball, baseball, tennis ball, hockey puck, or any other type of object that can be placed on pedestals.

A smaller object 72 is illustrated in FIG. 1B, FIG. 2B, FIG. 13B, and FIG. 14B.

The smaller object 72 is a golf ball, golf poly-ball, ping pong ball, or any other sized object that is about ⅔ smaller than the object 68.

A location member 76 is illustrated in FIGS. 7A-7B, FIGS. 14A-14B, and FIG. 16.

The location member 76, in one embodiment, is molded into the base 48 by making the inside diameter of the location member 76 a press fit with the outside diameter of the stem 36 or with the outside diameter of the flex member 52.

Figure 7A:
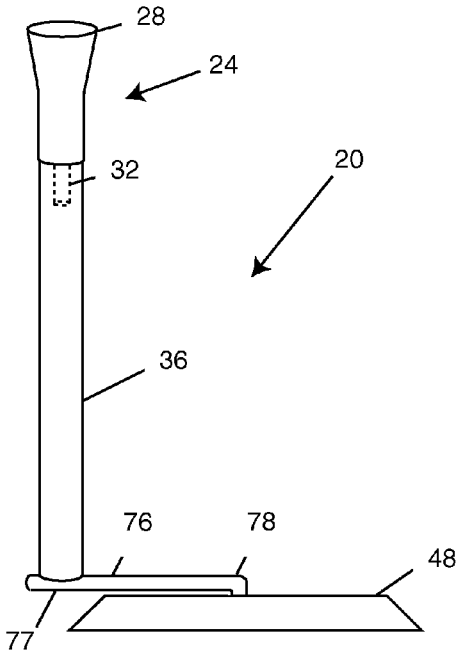
FIGS. 7A-7B is a perspective side view of a hitting device embodiment comprising a location member.

The location member 76, in another embodiment, is illustrated in FIG. 7A and FIG. 15B. In this embodiment, the location member 76 is fabricated from a flat piece of metal which measures approximately 12" in length, 2" in width, and 0.125" in thickness. A 0.500" diameter hole is drilled approximately 1" in from the proximal end 77 of the location member 76. Another 0.500" diameter hole is drilled approximately 1" in from the distal end 78 of the location member 76.

PREFERRED EMBODIMENTS

Operation

FIGS. 1A-16 illustrate several preferred embodiments of a new hitting device 20.

The hitting device 20 is used in one application for disposing various sized objects above a surface to allow sports players to hit objects off the hitting device 20.

Figure 1B:
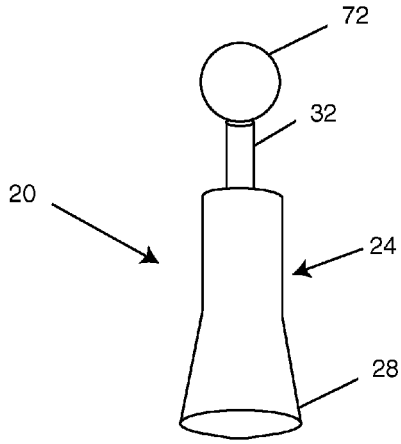
FIG. 1B is a perspective side view of a hitting device embodiment comprising a plural ended pedestal supporting a smaller object.

FIGS. 1A-1B illustrate a hitting device 20 comprising a plural ended pedestal 24.

The plural ended pedestal 24 comprises at least one end having a pedestal 28 for supporting at least one object 68 and at least one end having a smaller pedestal 32 for supporting at least one smaller object 72. When the plural ended pedestal 24 has an object 68 placed on the pedestal 28 the user hits the object 68 off the pedestal 28 and then puts another object 68 on the pedestal 28 and hits the object 68 off the pedestal 28 again. The user repeats this process over and over again to become a better hitter. Once the user becomes a better hitter, the user rotates the plural ended pedestal 24 180 degrees so the smaller pedestal 32 is in the object supporting position. The user then places a smaller object 72 on the smaller pedestal 32 and hits the smaller object 72 off the smaller pedestal 32. The user repeats this process over and over again to develop a precisely focused hitter's eye.

Figure 2A:
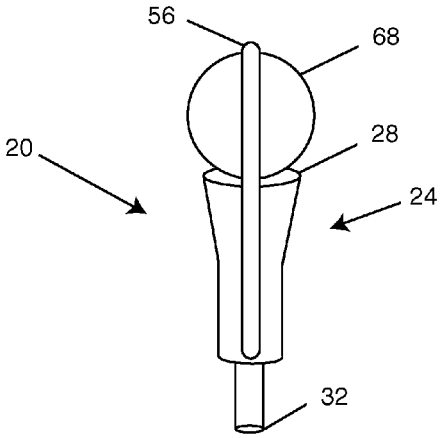
FIG. 2A-2B is a perspective side view of a hitting device embodiment comprising a plural ended pedestal and associated object holder for removably attaching various sized objects.
Figure 2B:
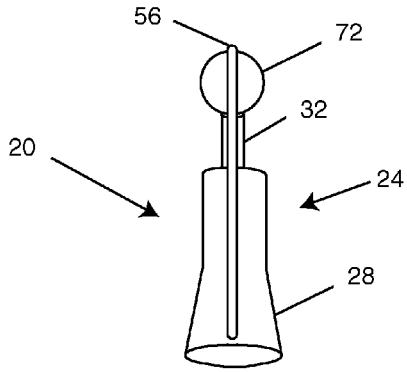

FIGS. 2A-2B illustrate another preferred embodiment of the hitting device 20. This preferred embodiment includes the same embodiment described above in FIGS. 1A-1B further comprising an object holder 56.

The plural ended pedestal 24 with at least one object holder 56 is associated with the plural ended pedestal 24 for removably connecting various sized objects to the plural ended pedestal 24. To utilize this embodiment, the object holder 56 is associated with the plural ended pedestal 24 by permanently attaching or removably attaching the plural ended pedestal 24 to the object holder 56. The user either sets an object 68 on the pedestal 28 or a smaller object 72 on the smaller pedestal 32. The user then stretches or straps the object holder 56 over the object 68 or the smaller object 72. The user then hits the various sized objects off the plural ended pedestal 24.

Figure 3A:
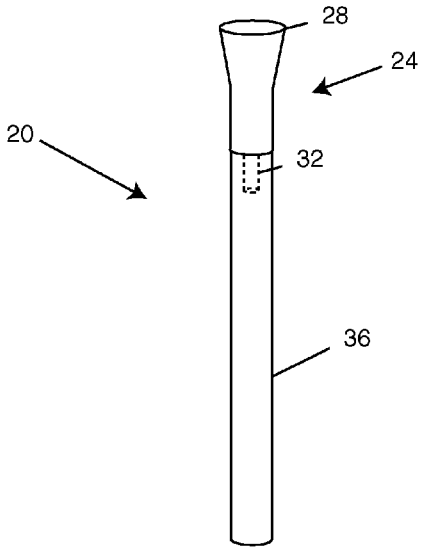
FIGS. 3A-3B is a perspective side view of a hitting device embodiment comprising a stem disposed below a plural ended pedestal.
Figure 3B:
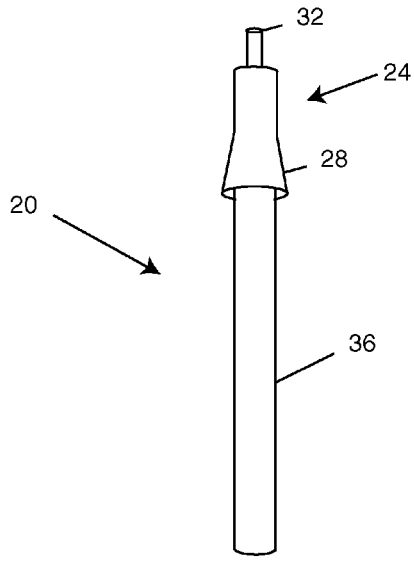

FIGS. 3A-3B illustrate another preferred embodiment of the hitting device 20. This preferred embodiment includes the same embodiment described above in FIGS. 1A-1B further comprising a stem 36.

The stem 36 can be directly attached to the plural ended pedestal 24 by sliding the outside diameter of the stem 36 in the inside diameter of the plural ended pedestal 24. For an alternative attachment method, the attachment method described above is reversed. To do this, simply slide the outside diameter of the plural ended pedestal 24 into the inside diameter of the stem 36. In either configuration, the stem 36 lifts the plural ended pedestal 24 off a surface. The surface can be the ground, a table, or the like. The length of the stem 36 can be any length depending on how high the user prefers objects to be disposed above the surface. For baseball, softball, tennis players, or any player who hits objects from the hitting device 20, the stem 36 can be sized to a specific length for lifting the plural ended pedestal 24 off the surface so objects can be hit from the desired height as required by the specific sport.

Figure 4A:
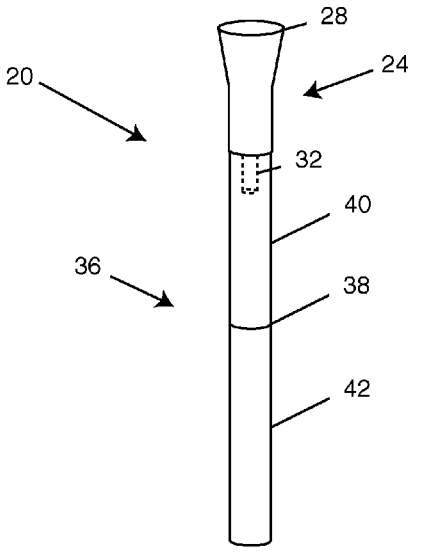
FIGS. 4A-4B is a perspective side view of a hitting device embodiment comprising a telescopic stem.
Figure 4B:
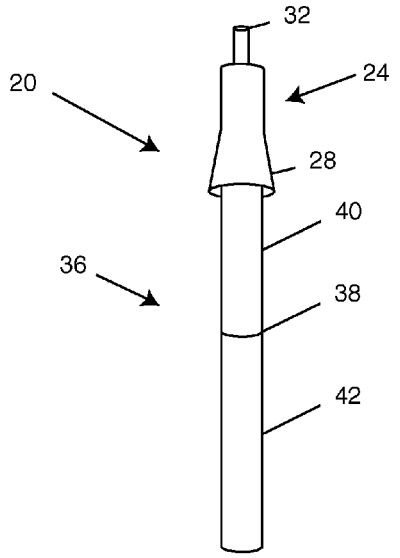

FIGS. 4A-4B illustrate another preferred embodiment of the hitting device 20. This preferred embodiment includes the same embodiment described above in FIGS. 3A-3B further comprising a telescopic 38 stem 36.

The telescopic 38 stem 36 allows the user to quickly adjust the height of the stem 36 for positioning various sized objects at different heights above the surface. To make the preferred telescopic embodiment, holes are fabricated in the upper stem 40 and the lower stem 42. A pushpin is inserted inside the diameter of the lower stem 42 until the pushpin head expands out of a hole in the lower stem 42. The upper stem 40 is slid over the lower stem 42 until the upper stem 40 hits the head of the pushpin. The pushpin head is compressed and the upper stem 40 is slid over the pushpin until the pushpin head expands out of a hole in the upper stem 40. To change the height of the stem 36, press in the pushpin and slide the upper stem 40 up or down the lower stem 42 until the pushpin head expands into a different hole in the upper stem 40.

Figure 5A:
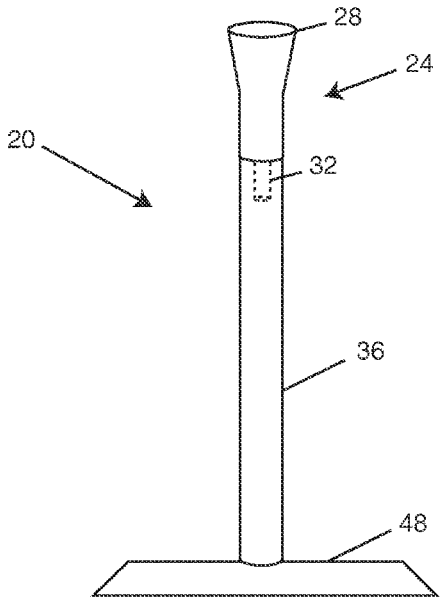
FIGS. 5A-5B is a perspective side view of a hitting device embodiment comprising a base disposed below the stem.
Figure 5B:
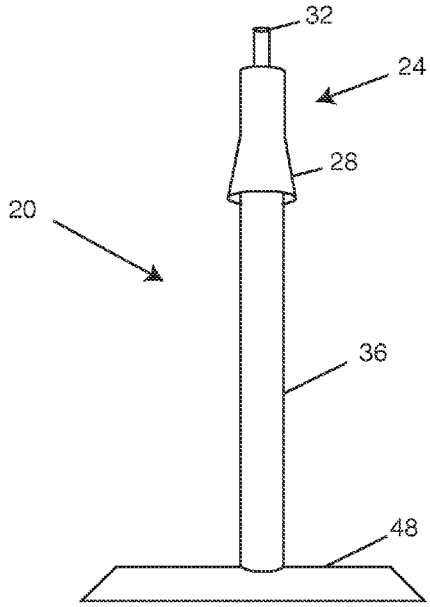

FIGS. 5A-5B illustrate another preferred embodiment of the hitting device 20. This preferred embodiment includes the same embodiment described above in FIGS. 3A-3B further comprising a base 48 used for supporting the plural ended pedestal 24 and stem 36 in an approximate upright position.

The base 48 is disposed below the stem 36 by attaching the base 48 and stem 36.

The base 48 can be attached to the stem 36 using an attachment member such as a bolt. In this embodiment, the stem 36 is threaded at the end closest to the base 48. The base 48 has a through hole in the center of the base 48. An attachment member such as a bolt is inserted through the base 48 until the head of the bolt rests against the underside of the base 48. At this point, the bolt is extending out the top of the base 48. The stem 36 is then threaded onto the bolt and tightened to the base 48.

Figure 6A:
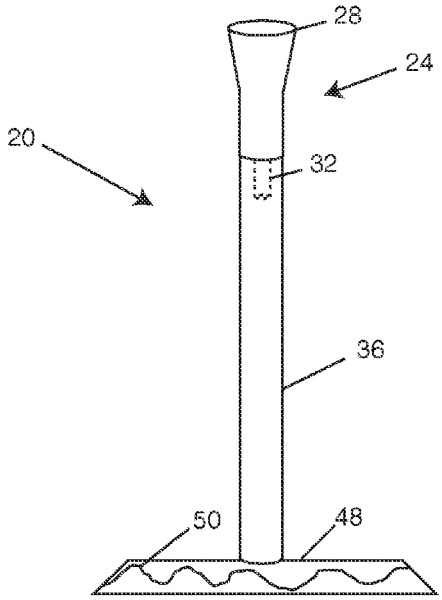
FIGS. 6A-6B is a perspective side view of a hitting device embodiment comprising a weight-fillable base.
Figure 6B:
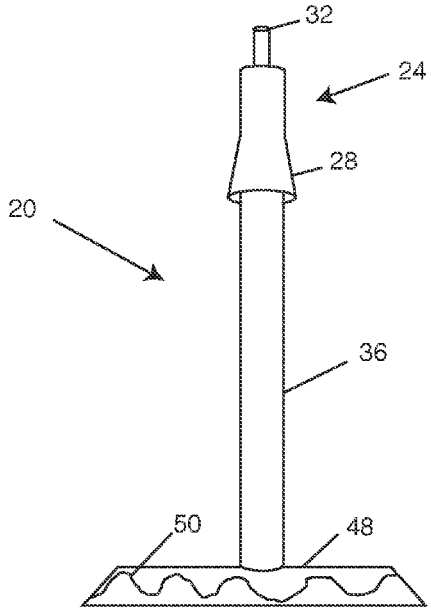

FIGS. 6A-6B illustrate another preferred embodiment of the hitting device 20. This preferred embodiment includes the same embodiment described above in FIGS. 5A-5B further comprising a weight-fillable 50 base 48.

The weight-fillable 50 base 48 is used for stabilizing the base 48. The weight-fillable 50 base 48 also supports the plural ended pedestal 24 and stem 36 in an approximate upright position.

The weight-fillable 50 base 48, in one embodiment, is a blow molded base with a cap that can be opened and closed. To fill the weight-fillable 50 base 48, simply open the cap and pour water, sand, concrete, or any weighted material into the opening. Once filled, close the cap.

Figure 7B:
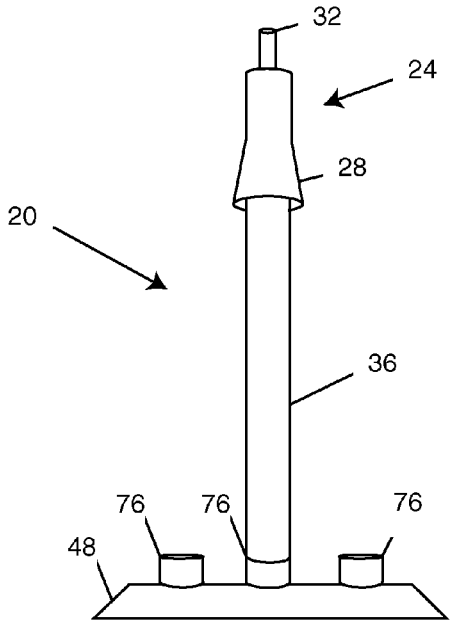

FIGS. 7A-7B illustrate another preferred embodiment of the hitting device 20. This preferred embodiment includes the same embodiment described above in FIGS. 5A-5B further comprising at least one location member 76 for positioning the plural ended pedestal 24 at various locations associated with the base 48.

In FIG. 7A, the location member 76 is an approximate 12" arm. In this embodiment, the user connects the proximal end 77 of the location member 76 to the stem 36 and the distal end 78 of the location member 76 to a pivot point on the base 48. In this configuration, the user hits objects from the hitting device 20 and then rotates the stem 36 to position the stem 36 in another position for hitting. The location member 76 changes positions by rotating around the base 48 similar to the way the hand on a clock rotates around the clock face.

In FIG. 7B, the location member 76 is molded into the base 48 in one embodiment. In this embodiment, the user slides the outside diameter of the stem 36 into the inside diameter of the location member 76. The user can then hit various sized objects at this location. To change object location, simply remove the stem 36 and place it in another location member 76 of the base 48.

Figure 8A:
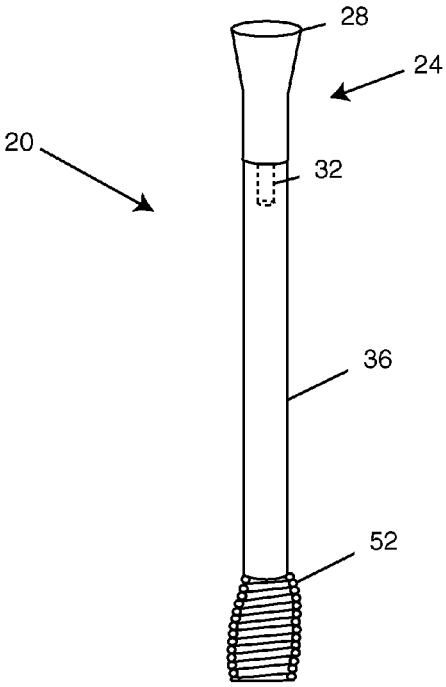
FIGS. 8A-8B is a perspective side view of a hitting device embodiment comprising a flex member.
Figure 8B:
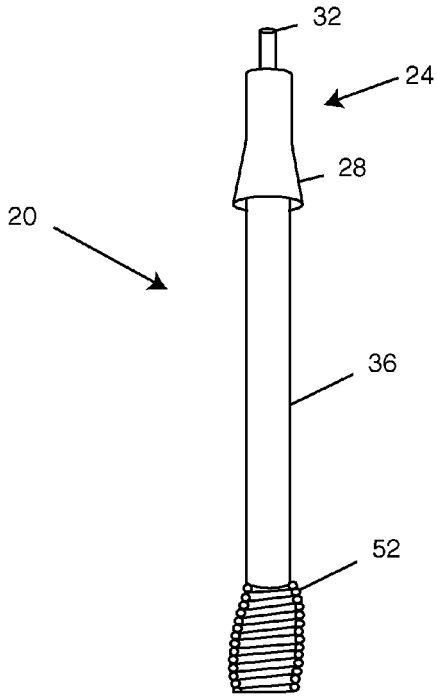

FIGS. 8A-8B illustrate another preferred embodiment of the hitting device 20. This preferred embodiment includes the same embodiment described above in FIGS. 3A-3B further comprising a flex member 52 disposed below the stem 36 for allowing the stem 36 to flex.

In this embodiment, the flex member 52 is a coil spring and is attached to the stem 36. The flex member 52 allows the stem 36 to flex when various size objects are hit off the plural ended pedestal 24. To connect the flex member 52 to the stem 36 various methods can be used.

To connect the flex member 52 and the stem 36 fabricate the outside diameter of the flex member 52 just large enough to create a press fit with the inside diameter of the coil spring. In this way the stem 36 can quickly and easily be pressed into the coil spring during the assembly process.

In another embodiment, connecting the flex member 52 to the stem 36 includes threading the end of the stem 36 about 3-6 thread lengths. The thread diameter should be approximately the size of the coil spring steel wire. In this configuration, the stem 36 is screwed into the coil spring. This attachment method creates a permanent or removable connection method for the stem 36 and flex member 52.

Figure 9A:
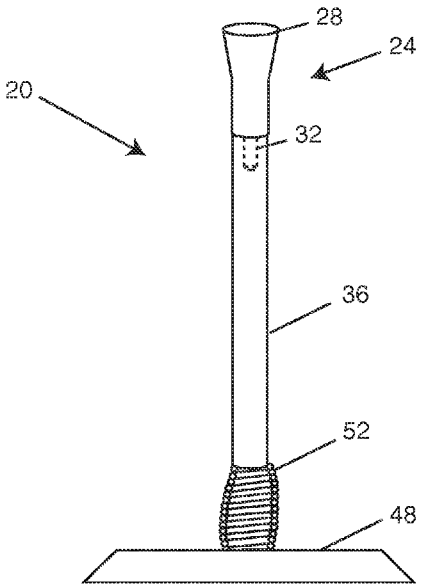
FIGS. 9A-9B is a perspective side view of an assembled hitting device embodiment comprising a base.
Figure 9B:
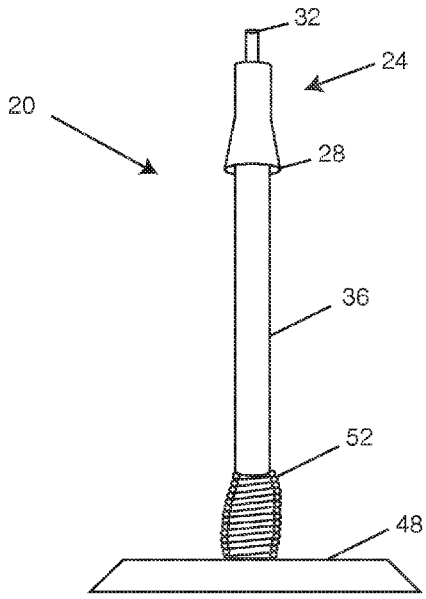

FIGS. 9A-9B illustrate another preferred embodiment of the hitting device 20. This preferred embodiment includes the same embodiment described above in FIGS. 8A-8B further comprising a base 48 disposed below the flex member 52.

The base 48 is disposed below the flex member 52 by attaching the base 48 to the flex member 52.

The base 48 and flex member 52 are connected by using an attachment member such as a bolt. In this embodiment, the flex member 52 is a coil spring. The base 48 has a through hole in the center of the base 48. An attachment member such as a bolt is inserted through the base 48 until the head of the bolt rests against the underside of the base 48. At this point, the bolt is extending out the top of the base 48. The flex member 52 is then threaded onto the bolt and tightened to the base 48. The bolt has the same thread size as the inside diameter of the coil spring wire.

In this configuration, the end of the spring has natural threads created by the winding of the coil spring. The natural winding of the coil spring wire creates female threads on the inside diameter of the coil spring. This allows the bolt to naturally screw in to the inside diameter of the coil spring. A threaded fitting could also be fabricated to screw over the outside diameter of the coil spring. This would be another method for attaching the flex member 52 to the base 48

Figure 10A:
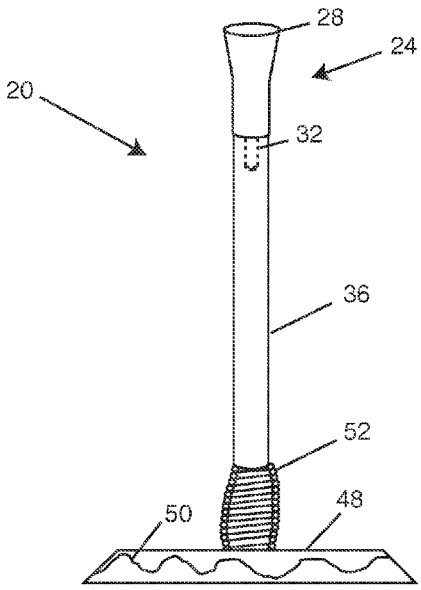
FIGS. 10A-10B is a perspective side view of a hitting device embodiment comprising a weight-fillable base and flex member.
Figure 10B:
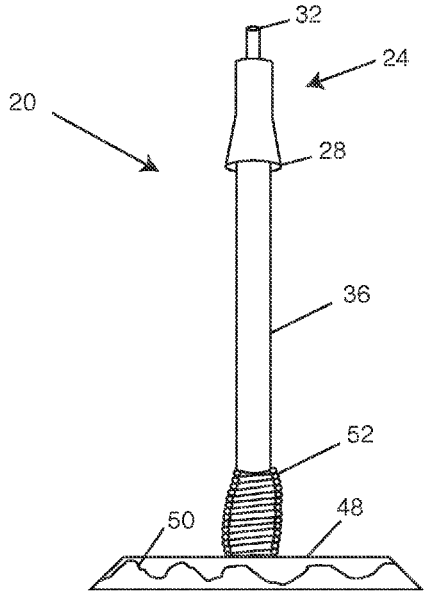

FIGS. 10A-10B illustrate another preferred embodiment of the hitting device 20. This preferred embodiment includes the same embodiment described above in FIGS. 9A-9B further comprising a base 48 that is weight-fillable 50 for stabilizing the base 48.

The weight-fillable 50 base 48 is used for stabilizing the base 48. The weight-fillable 50 base 48 also supports the plural ended pedestal 24, stem 36, and flex member 52 in an approximate upright position.

The weight-fillable 50 base 48, in one embodiment, is a blow molded base with a cap that can be opened and closed. To fill the weight-fillable 50 base 48, simply open the cap and pour water, sand, concrete, or any weighted material into the opening. Once filled, close the cap.

To operate this embodiment, the user hits objects off the plural ended pedestal 24. When objects are hit, the plural ended pedestal 24 and the stem 36 flex away from the impact element and then returns back into position. The impact element could be a bat, club, stick, or the like. The flexing motion of the plural ended pedestal 24 and the stem 36 take place because they are disposed above the flex member 52 and connected to the flex member 52. The weight-fillable 50 base 48 keeps the hitting device 20 from tipping over.

Figure 11A:
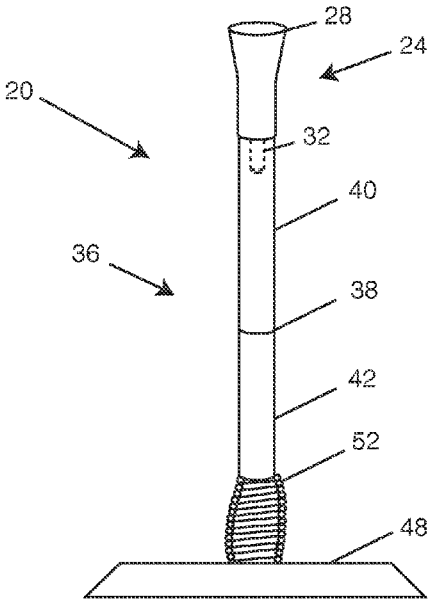
FIGS. 11A-11B is a perspective side view of an assembled hitting device embodiment comprising a telescopic stem and flex member.
Figure 11B:
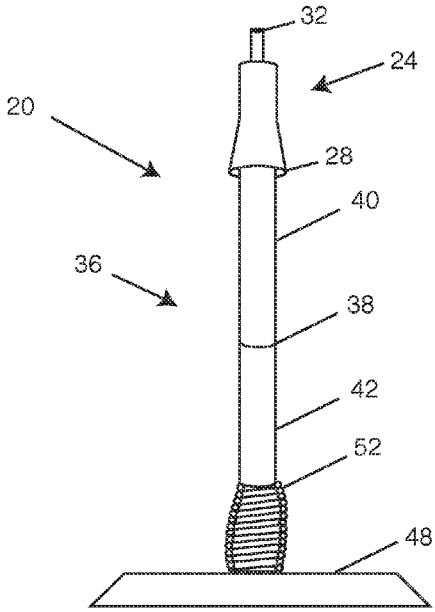

FIGS. 11A-11B illustrate another preferred embodiment of the hitting device 20. This preferred embodiment includes the same embodiment described above in FIGS. 10A-10B wherein the stem 36 is telescopic 38.

The telescopic 38 stem 36 allows the user to quickly adjust the height of the stem 36 for positioning various sized objects at different heights above the surface. To make the preferred telescopic embodiment, holes are fabricated in the upper stem 40 and the lower stem 42. A pushpin is inserted inside the diameter of the lower stem 42 until the pushpin head expands out of a hole in the lower stem 42. The upper stem 40 is slid over the lower stem 42 until the upper stem 40 hits the head of the pushpin. The pushpin head is compressed and the upper stem 40 is slid over the pushpin until the pushpin head expands out of a hole in the upper stem 40. To change the height of the stem 36, the user presses in the pushpin and slides the upper stem 40 up or down the lower stem 42 until the pushpin head expands into a different hole in the upper stem 40.

Figure 12A:
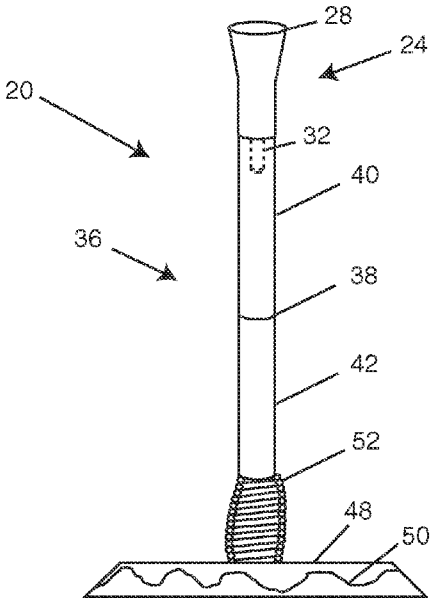
FIGS. 12A-12B is a perspective side view of a hitting device embodiment comprising a telescopic stem and weight-fillable base.
Figure 12B:
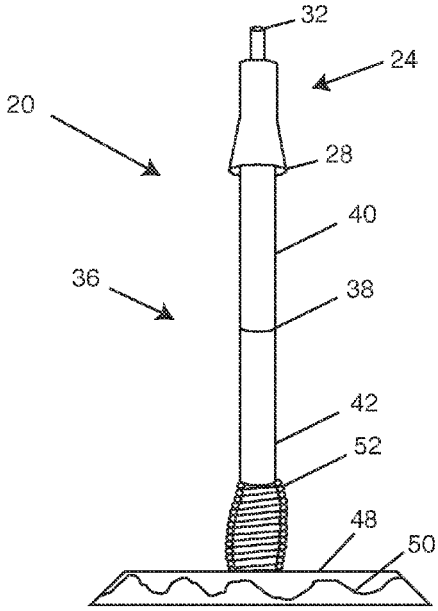

FIGS. 12A-12B illustrate another preferred embodiment of the hitting device 20. This preferred embodiment includes the same embodiment described above in FIGS. 11A-11B wherein the base 48 is weight-fillable 50 for stabilizing the base 48.

The weight-fillable 50 base 48 is used for stabilizing the base 48 and also supports the plural ended pedestal 24, stem 36, and flex member 52 in an approximate upright position.

The weight-fillable 50 base 48, in one embodiment, is a blow molded base with a cap that can be opened and closed. To fill the weight-fillable 50 base 48, simply open the cap and pour water, sand, concrete, or any weighted material into the opening. Once filled, close the cap.

To operate this embodiment, the user hits objects off the plural ended pedestal 24. When objects are hit, the plural ended pedestal 24 and the stem 36 flex away from the impact element and then returns back into position. The impact element could be a bat, club, stick, or the like. The flexing motion of the plural ended pedestal 24 and the stem 36 take place because they are disposed above the flex member 52 and connected to the flex member 52. The weight-fillable 50 base 48 keeps the hitting device 20 from tipping over.

Figure 13A:
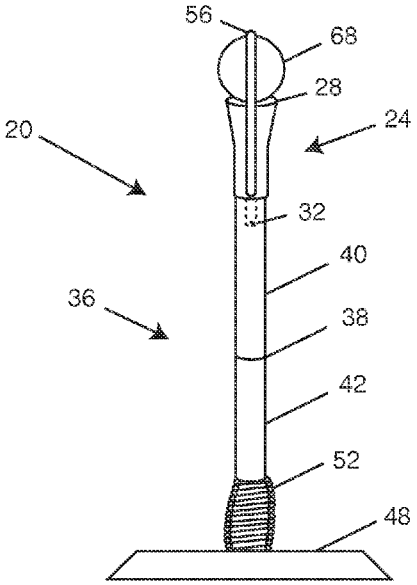
FIGS. 13A-13B is a perspective side view of a hitting device embodiment comprising an added object holder associated with the stem.
Figure 13B:
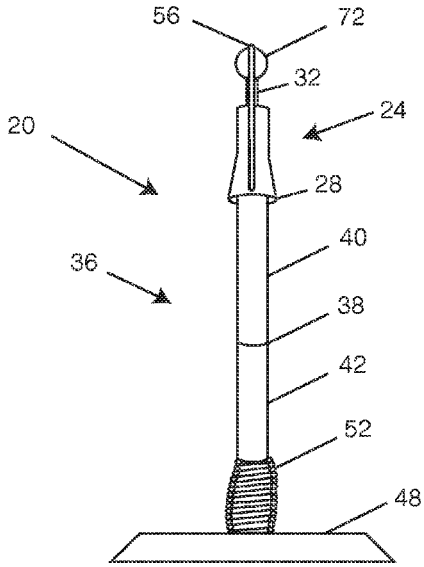

FIGS. 13A-13B illustrate another preferred embodiment of the hitting device 20. This preferred embodiment includes the same embodiment described above in FIGS. 11A-11B, further comprising at least one object holder 56 for removably connecting various sized objects to the plural ended pedestal 24. The object holder 56 is described in detail in reference FIGS. 2A-2B above.

To operate this embodiment, the user places an object 68 or smaller object 72 on the plural ended pedestal 24. The user then slides the object holder 56 over the top of the object 68 or smaller object 72. This removably attaches the object 68 or smaller object 72 to the plural ended pedestal 24. The user then pushes the plural ended pedestal 24 to set the plural ended pedestal 24 in a rocking back and forth motion. This rocking motion allows the user to hit a moving object 68 or moving smaller object 72. Once hit, the object holder 56 releases the object 68 or smaller object 72 from the plural ended pedestal 24 and allows the object 68 or smaller object 72 to fly off the plural ended pedestal 24.

Figure 14A:
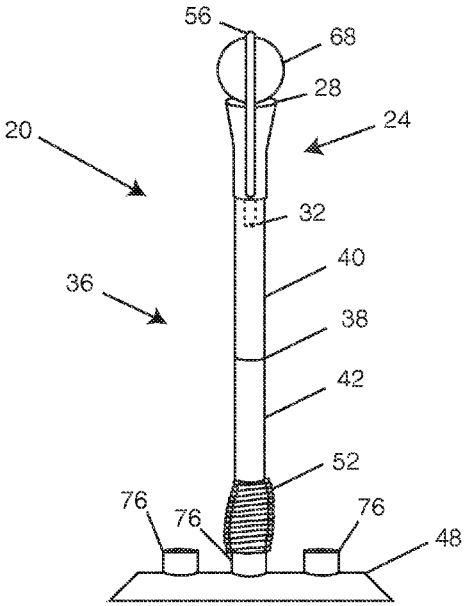
FIGS. 14A-14B is a perspective side view of a hitting device embodiment comprising a location member.
Figure 14B:
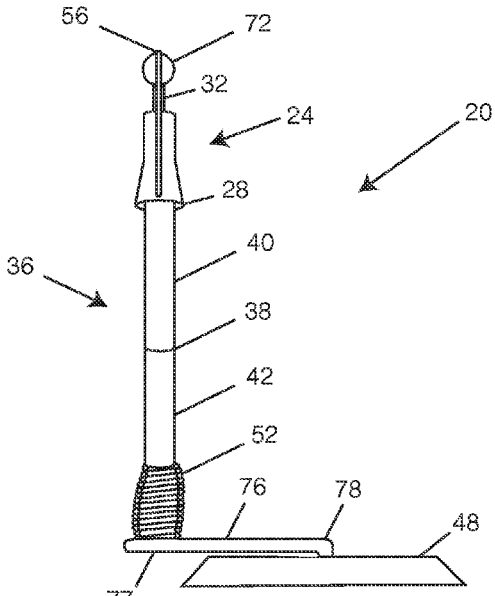

FIGS. 14A-14B illustrate another preferred embodiment of the hitting device 20. This preferred embodiment includes the same embodiment described above in FIGS. 13A-13B, further comprising at least one location member 76 for positioning the plural ended pedestal 24 at various locations associated with the base 48. The location member 76 is described in detail in FIGS. 7A-7B above.

FIGS. 15-16 illustrate another preferred embodiment of the hitting device 20. This preferred embodiment comprises a single size pedestal 34 having at least one pedestal 28 for supporting at least one object 68 and an object holder 56 associated with the single size pedestal 34 for removably attaching objects to the single size pedestal 34.

This embodiment is used in the same way as the embodiment described above in FIGS. 2A-2B, except for the exclusion of the smaller pedestal 32. By eliminating the smaller pedestal 32, a single size pedestal 34 is created. The single size pedestal 34 allows users to hit an object 68 of sufficient size to have a majority of the circumference of the object 68 exposed from the single size pedestal 34.

FIG. 16 illustrates another preferred embodiment of the hitting device 20. This preferred embodiment includes the same embodiment described above in FIG. 15 further comprising a stem 36 disposed below the single size pedestal 34.

The stem 36 can be directly attached to the single size pedestal 34 by sliding the outside diameter of the stem 36 in the inside diameter of the single size pedestal 34. For an alternative attachment method, reverse the attachment method, described above, simply by sliding the outside diameter of the single size pedestal 34 into the inside diameter of the stem 36. In either configuration, the stem 36 lifts the single size pedestal 34 off a surface. The surface can be the ground, a table, or the like. The length of the stem 36 can be any length depending on how high the user prefers objects to be disposed above the surface. For baseball, softball, tennis players, or any player who hits an object 68 from the hitting device 20, the stem 36 can be sized in any length to lift the plural ended pedestal 24 off the surface so an object 68 can be hit from the desired height as required by the hitter.

Another embodiment illustrated in FIG. 16 further comprises a flex member 52 disposed below the stem 36 for allowing the stem 36 to flex.

In this embodiment, the flex member 52 is a coil spring and is attached to the stem 36. The flex member 52 allows the stem 36 to flex when various size objects are hit off the plural ended pedestal 24. To connect the flex member 52 to the stem 36 various methods can be used.

To connect the flex member 52 and the stem 36 fabricate the outside diameter of the flex member 52 just large enough to create a press fit with the inside diameter of the coil spring. In this way the stem 36 can quickly and easily be pressed into the coil spring during the assembly process.

In another embodiment, connecting the flex member 52 to the stem 36 includes threading the end of the stem 36 about 3-6 thread lengths. The thread diameter should be approximately the size of the coil spring steel wire. In this configuration, the stem 36 is screwed into the coil spring. This attachment method creates a permanent or removable connection method for the stem 36 and flex member 52.

In another embodiment FIG. 16, illustrates a stem 36 that is telescopic 38.

The telescopic 38 stem 36 allows the user to quickly adjust the height of the stem 36 for positioning various sized objects at different heights above the surface. To make the preferred telescopic embodiment, holes are fabricated in the upper stem 40 and the lower stem 42. A pushpin is inserted inside the diameter of the lower stem 42 until the pushpin head expands out of a hole in the lower stem 42. The upper stem 40 is slid over the lower stem 42 until the upper stem 40 hits the head of the pushpin. The pushpin head is compressed and the upper stem 40 is slid over the pushpin until the pushpin head expands out of a hole in the upper stem 40. To change the height of the stem 36, press in the pushpin and slide the upper stem 40 up or down the lower stem 42 until the pushpin head expands into a different hole in the upper stem 40.

Another embodiment illustrated in FIG. 16, further comprises a base 48 disposed below the flex member 52.

The base 48 and flex member 52 can be connected by using an attachment member such as a bolt. In this embodiment, the flex member 52 is a coil spring. The base 48 has a through hole in the center of the base 48. An attachment member such as a bolt is inserted through the base 48 until the head of the bolt rests against the underside of the base 48. At this point, the bolt is extending out the top of the base 48. The flex member 52 is then threaded onto the bolt and tightened to the base 48. The bolt has the same thread size as the inside diameter of the coil spring wire.

In this configuration, the end of the spring has natural threads created by the winding of the coil spring. The natural winding of the coil spring wire creates female threads on the inside diameter of the coil spring. This allows the bolt to naturally screw in to the inside diameter of the coil spring. A threaded fitting could also be fabricated to screw over the outside diameter of the coil spring. This would be another method for attaching the flex member 52 to the base 48

Another embodiment in FIG. 16 illustrates a base 48 that is weight-fillable 50 for stabilizing the base 48.

The weight-fillable 50 base 48, in one embodiment, is a blow molded base with a cap that can be opened and closed. To fill the weight-fillable 50 base 48, simply open the cap and pour water, sand, concrete, or any weighted material into the opening. Once filled, close the cap.

To operate this embodiment, the user hits objects off the plural ended pedestal 24. When objects are hit, the plural ended pedestal 24 and the stem 36 flex away from the impact element and then returns back into position. The impact element could be a bat, club, stick, or the like. The flexing motion of the plural ended pedestal 24 and the stem 36 take place because they are disposed above the flex member 52 and connected to the flex member 52. The weight-fillable 50 base 48 keeps the hitting device 20 from tipping over.

Another embodiment illustrated in FIG. 16 further comprises at least one location member 76 for positioning the single size pedestal 34 at various locations to the base 48.

In FIG. 16, the location member 76 is molded into the base 48 in one embodiment. In this embodiment, the user slides the outside diameter of the stem 36 into the inside diameter of the location member 76. The user can then hit objects from this location. To change object location, simply remove the stem 36 and place it in another location member 76 of the base 48.

In another embodiment the location member 76 is an approximate 12" arm. In this embodiment, the user connects the proximal end 77 of the location member 76 to the stem 36 and the distal end 78 of the location member 76 to a pivot point on the base 48. In this configuration, the user hits objects from the hitting device 20 and then rotates the stem 36 to position the stem 36 in another position for hitting. The location member 76 changes positions by rotating around the base 48 similar to the way the hand on a clock rotates around the clock face.

FIGS. 9A-9B illustrate how to assemble one embodiment of a hitting device 20. To assemble the hitting device 20, provide a base 48 and dispose a flex member 52 above the base 48. Dispose a stem 36 above the flex member 52 and dispose a plural ended pedestal 24 above the stem 36.

FIGS. 13A-13*b* illustrate how to assemble one embodiment of a hitting device 20. To assemble the hitting device 20, provide a base 48 and dispose a flex member 52 above the base 48. Dispose a stem 36 above the flex member 52 and dispose a plural ended pedestal 24 above the stem 36 associate an object holder 56 with the plural ended pedestal 24 for removably attaching various sized objects to the plural ended pedestal 24.

FIG. 16 illustrates how to assemble one embodiment of a hitting device 20. To assemble the hitting device 20, provide a base 48 and dispose the flex member 52 above the base 48. Dispose a stem 36 above the flex member 52. Dispose a single size pedestal 34 above the stem 36 and associate an object holder 56 to the single size pedestal 34 for removably attaching objects.

SCOPE OF INVENTION

The present invention may be embodied in other specific forms without departing from its spirit or essential characteristics. The described embodiments are to be considered in all respects only as illustrative and not restrictive. Thus, the scope of the invention should be determined by the appended claims and their legal equivalents, rather than by the foregoing description. All changes which come within the meaning and range of equivalency of the claims are to be embraced within their scope.

I claim:

1. A hitting device for use with a first ball and a second ball, the second ball being smaller in size than the first ball, the device comprising:

a) a stem having a first end and a second end; and b) a plural ended ball pedestal, the plural ended ball pedestal removably attached to the first end of the stem, the plural ended ball pedestal comprising:

i) a first end having a cup for supporting the first ball; and ii) a second end having a nipple for supporting the second ball, the nipple extends within the first end of the stem when the cup is in a use position.

2. The device in claim 1, further comprising a ball-to-pedestal temporary fastener capable of temporarily fastening the first sized ball or the second sized ball to the plural ended ball pedestal.

3. The device in claim 1, wherein the stem is telescopic.

4. The device in claim 1, further comprising a base disposed below the stem.

5. The device in claim 4, wherein the base is weight-fillable for stabilizing the base.

6. The device in claim 5, further comprising at least one location member for positioning the plural ended ball pedestal in at least one position associated with the base.

7. The device in claim 1, further comprising a flex member disposed below the stem for allowing the stem to flex.

8. The device in claim 7, further comprising a base disposed below the flex member.

9. The device in claim 8, wherein the base is weight-fillable for stabilizing the base.

10. The device in claim 8, wherein the stem is telescopic.

11. The device in claim 10, wherein the base is weight-fillable for stabilizing the base.

12. The device in claim 11, further comprising a ball-to-pedestal temporary fastener capable of temporarily fastening the first sized ball or the second sized ball to the plural ended ball pedestal.

13. The device in claim, further comprising at least one location member for positioning the plural ended ball pedestal in at least one position associated with the base.

14. A hitting device for accommodating a first ball and a second ball, the second ball being smaller in size than the first ball, the device comprising:

a) a stem having a first end and a second end;

b) a plural ended ball pedestal having a first end and a second end, the ball pedestal removably attached to the first end of the stem;

c) a non-invasive and non-altering temporary fastener attached to the ball pedestal for releasably positioning one of the first or the second ball on the ball pedestal;

d) a flex member disposed below the stem for allowing the stem to flex; and e) a base disposed below the flex member for supporting the hitting device in an upright configuration.

15. The device in claim 14, wherein the stem is telescopic.

16. The device in claim 15, wherein the base is weight-fillable for stabilizing the base.

17. The device in claim 16, further comprising at least one location member for positioning the ball pedestal in at least one position associated with the base.

18. A method of using a hitting device for use with a first ball and a second ball, the second ball being smaller in size than the first ball, the method comprising the steps of:

a) providing a stem, the stem having a first end and a second end;

b) providing a plural ended ball pedestal, the plural ended ball pedestal comprising:

i) a first end having a cup for supporting the first ball; and ii) a second end having a nipple for supporting the second ball, the nipple extends within the first end of the stem when the cup is in a use position;

c) removably attaching the plural ended ball pedestal to the first end of the stem;

d) attaching a flex member to the second end of the stem;

e) attaching a non-invasive and non-altering ball-to-pedestal temporary fastener to the ball pedestal;

f) placing the first ball on the cup and attaching the temporary fastener to the first ball; or placing the second ball on the nipple and attaching the temporary fastener to the second ball; and g) a user in a stance position impacting the first or the second ball off of the plural ended ball pedestal, the hitting device is flexed away from the user and then returns back into position.

19. A method of assembling a hitting device for use with a first ball and a second ball, wherein the second ball is smaller in size than the first ball, the method comprising the steps of:

a) providing a stem having a first end and a second end;

b) providing a plural ended ball pedestal, the plural ended ball pedestal comprising:

i) a first end having a cup capable of supporting the first ball; and ii) a second end having a nipple capable of supporting the second ball, the nipple extends within the first end of the stem when the cup is in a use position;

c) removably attaching the plural ended ball pedestal to the first end of the stem;

d) providing a non-invasive ball-to-pedestal temporary fastener;

e) attaching the non-invasive ball-to-pedestal temporary fastener to the ball pedestal;

f) placing the first ball on the cup and attaching the temporary fastener to the first ball; or placing the second ball on the nipple and attaching the temporary fastener to the second ball; and g) a user in a stance position impacting the first or the second ball off of the plural ended pedestal, the hitting device is flexed away from the user and then returns back into position.

20. A hitting device for use with a first ball and a second ball, the second ball being smaller in size than the first ball, the device comprising:

a) a stem having a first end and a second end;

b) a plural ended ball pedestal, the plural ended ball pedestal removably attached to the first end of the stem, the plural ended ball pedestal comprising:

i) a first end having a cup capable of supporting the first ball; and ii) a second end having a nipple capable of supporting the second ball, the nipple extends within the first end of the stem when the cup is in a use position;

c) a weight-fillable base disposed below the stem for stabilizing the base; and d) the weight-fillable base including at least on location member for positioning the plural ended ball pedestal at different positions on the base.

21. A hitting device for use with a first ball and a second ball, the second ball being smaller in size than the first ball, the device comprising:

a) a telescopic stem having a first end and a second end;

b) a plural ended ball pedestal, the plural ended ball pedestal removably attached to the first end of the stem, the plural ended ball pedestal comprising:

i) a first end having a cup capable of supporting the first ball; and ii) a second end having a nipple capable of supporting the second ball, wherein the nipple extends within the first end of the stem when the cup is in a use position;

c) a flex member disposed below the stem for allowing the stem to flex when the hitting device is in use;

d) a weight-fillable base for stabilizing the base, the weight-fillable base being disposed below the flex member;

e) the weight-fillable base including at least one location member for positioning the plural ended ball pedestal at different positions on the base; and f) a ball-to-pedestal temporary fastener for temporarily fastening one of the first ball or the second ball to the plural ended ball pedestal.

22. A hitting device for use with a first ball and a second ball, the second ball being smaller in size than the first ball, the device comprising:

a) a telescopic stem having a first end and a second end;

b) a plural ended ball pedestal, the plural ended ball pedestal removably attached to the first end of the stem;

c) a flex member disposed below the stem, the flex member capable of allowing the stem to flex when the hitting device is in use;

d) a weight-fillable base for stabilizing the base disposed below the flex member; and e) the weight-fillable base including at least one location member for positioning the plural ended ball pedestal at different positions on the base.

23. The device in claim 22 further comprising:

a ball-to-pedestal temporary fastener capable of temporarily fastening the first ball or the second ball to the plural ended ball pedestal ball pedestal.

* * * * *